US007413506B2

(12) United States Patent
Arai

(10) Patent No.: US 7,413,506 B2
(45) Date of Patent: Aug. 19, 2008

(54) VENTILATED HELMET

(76) Inventor: Michio Arai, c/o Arai Helmet, Ltd. 12, Azuma-cho, 2-Chome, Ohmiya-Ku, Saitama-Shi, Saitama (JP)

( * ) Notice: Subject to any disclaimer, the term of this patent is extended or adjusted under 35 U.S.C. 154(b) by 0 days.

(21) Appl. No.: 11/489,528

(22) Filed: Jul. 20, 2006

(65) Prior Publication Data

US 2007/0238405 A1 Oct. 11, 2007

(30) Foreign Application Priority Data

Apr. 10, 2006 (JP) ..... 2006-107461

(51) Int. Cl.
*A42B 3/28* (2006.01)
*A42B 3/04* (2006.01)

(52) U.S. Cl. ..... 454/370; 2/171.3; 2/410; 2/424

(58) Field of Classification Search ..... 454/121, 454/370; 2/171.3, 410, 414, 424, 425, DIG. 1
See application file for complete search history.

(56) References Cited

U.S. PATENT DOCUMENTS 3,496,854 A * 2/1970 Hill et al. ..... 454/370
4,964,178 A * 10/1990 Giancarlo et al. ..... 2/414
5,086,520 A * 2/1992 Arai ..... 2/424
5,093,938 A * 3/1992 Kamata ..... 2/424
5,170,511 A * 12/1992 Kamata ..... 2/424
5,388,278 A * 2/1995 Taniuchi ..... 2/422
5,996,128 A * 12/1999 Yanagihara ..... 2/422
6,061,834 A * 5/2000 Liao ..... 2/171.3
6,263,513 B1 * 7/2001 Murakami ..... 2/171.3
6,910,228 B2 * 6/2005 Tanaka ..... 2/424
2005/0066416 A1 * 3/2005 Ma ..... 2/171.3

FOREIGN PATENT DOCUMENTS

EP 818156 A2 * 1/1998
JP 06184804 A * 7/1994
JP 8291422 8/1996
JP 08291422 A * 11/1996

* cited by examiner

*Primary Examiner*—Steven B. McAllister
*Assistant Examiner*—Patrick F. O'Reilly, III
(74) *Attorney, Agent, or Firm*—Dykema Gossett PLLC

(57) ABSTRACT

The present invention can easily perform mounting and dismounting of a guiding duct in the ventilation structure of a helmet. A support portion which detachably supports a guiding duct is arranged at the center of rotation of a closure plate and a manipulation portion for the guiding duct which releases the support of the guiding duct is provided to the support portion.

12 Claims, 11 Drawing Sheets

VENTILATED HELMET

BACKGROUND OF THE INVENTION

The present invention relates to a helmet which a user wears for protecting his/her head and face when the user rides on various kinds of moving vehicles such as an automobile, a motorcycle and the like, watercraft such as a motorboat and movable equipment such as a bicycle and the like, and more particularly to a helmet which includes the ventilation structure for discharging hot air inside the helmet or for introducing outside air into the inside of the helmet.

As earlier technology information related to a helmet which includes the ventilation structure of the present invention, for example, there exists in Japanese Patent Laid-open Hei 8 (1996)-291422 (see [0010], [0011] and [FIG. 2]) which is referred as a Reference 1.

The ventilation structure of the helmet which is described in the Reference 1 is constituted by fixing a tunnel-shaped guiding duct to an opening of a ventilation hole which is formed in the vicinity of a substantially crest portion of a helmet body by adhesion.

That is, when a traveling wind which is introduced from a front opening portion of the guiding duct is discharged from a rear opening portion of the guiding duct while traveling, due to a negative pressure which is generated inside the guiding duct, hot air inside the helmet is sucked into the guiding duct from the ventilation hole and, at the same time, the hot air is discharged from a rear opening portion of the guiding duct along with the traveling wind which is introduced into the guiding duct.

SUMMARY OF THE INVENTION

Here, with respect to the above-mentioned ventilation structure, for example, there exist various structures including the structure described in the Reference 1 in which hot air inside the helmet is sucked from a discharge passage due to a negative pressure generated when the traveling wind passes the inside of the guiding duct, or the structure in which a traveling wind introducing opening and a ventilation hole are formed in a helmet body, a guiding duct which includes an opening portion only in a rear portion thereof is fixed to an opening of the ventilation hole by adhesion and the like, wherein a traveling wind is introduced into the inside of the helmet from the above-mentioned traveling wind introducing opening, hot air inside the helmet is forcibly discharged from the above-mentioned ventilation hole due to a pressure of the traveling wind introduced into the inside of the helmet, and the hot air is discharged from the rear opening portion.

However, in the above-mentioned ventilation structures, the guiding duct is fixed to a helmet body by adhesion and hence, for example, at the time of removing the guiding duct for the exchange of the guiding duct, the maintenance of the ventilation hole or the like, the removing operation is not easy. Further, in mounting the guiding duct again, an adjustment operation for ensuring the accuracy of the mounting position of the guiding duct is not easy.

That is, since the above-mentioned guiding duct is arranged using a means which fixes the guiding duct to the helmet body by adhesion, at the time of removing the helmet body, for example, there arises a possibility that painting of the helmet body is peeled off or the guiding duct is broken and a portion of the guiding duct remains on the helmet body. Further, when the mounting position of the guiding duct is deviated at the time of mounting the guiding duct, there may arise a possibility of the occurrence of the lowering of introduction efficiency of the traveling wind in the guiding duct, the lowering of discharge efficiency of hot air inside a helmet, and the lowering of a flow straightening effect of the guiding duct, for example.

The present invention is provided for facilitating the mounting and dismounting of a guiding duct in the ventilation structure of a helmet, and it is an object of the present invention to provide a helmet which includes the ventilation structure which can overcome the above-mentioned drawbacks.

To achieve the above-mentioned object, the first invention which the present invention adopts is directed to a helmet which includes a ventilation hole for ventilating a surface of a helmet body, a guiding duct which covers the ventilation hole, a closure plate which opens or closes the ventilation hole corresponding to the rotation in a direction along the surface of the helmet body and, at the same time, adjusts an opening area of the ventilation hole, and a manipulation portion for rotating the closure plate for rotatably manipulating the closure plate, wherein a support portion which detachably supports the guiding duct is arranged at the center of rotation of the closure plate, and a manipulation portion for detachably mounting the guiding duct which releases the support of the guiding duct is provided to the support portion.

The guiding duct which is referred to in the present invention includes both of a mode in which the opening portion is formed in the front and rear portions and a mode in which the opening portion is formed in one of the rear portion and the front portion.

Further, the above-mentioned guiding duct includes a flow straightening effect and hence, the guiding duct allows the traveling wind to flow rearwardly efficiently and smoothly thus suppressing the generation of noises, tilting of the helmet or the like attributed to the traveling wind.

Further, the above-mentioned guiding duct may be formed in a mode that the guiding duct is formed in a surface of the helmet body at one position as well as a mode that the guiding duct is formed in the surface of the helmet body at a plurality of positions.

Further, as the operation of closure plate which opens or closes the above-mentioned ventilation hole and also controls an opening area of the ventilation hole, there is an operation to control the opening area of the ventilation hole within a range from 0 to a maximum value by allowing the closure plate to pass over the ventilation hole in an overlapped manner with the ventilation hole by rotating the closure plate in the direction along the surface of the helmet body.

In this case, the opening area of the ventilation hole being "0" means a state in which the above-mentioned closure plate completely closes the ventilation hole, and the opening area of the ventilation hole being "maximum value" means a state in which the above-mentioned closure plate is separated from the ventilation hole so as to completely open the ventilation hole.

As an example of the specific constitution of the above-mentioned support portion, the second invention is directed to the constitution in which the support portion includes an engaging portion which is provided to one of a helmet body side and the guiding duct side, and a portion to be engaged which is detachably engaged with the engaging portion and is provided to the other, the engaging portion is configured to be engaged with the portion to be engaged in a sandwiched manner so as to maintain a support state of the guiding duct and is also configured to release the engagement with the portion to be engaged by enlarging the manipulation portion for mounting and dismounting the guiding duct by the slide manipulation of the manipulation portion so as to release the support state of the guiding duct.

From a view point of the reduction of constitutional members while performing the rotary manipulation of the above-mentioned closure plate and the removing manipulation of the guiding duct at one place, in the third invention, it is preferable that the manipulation portion for rotating the closure plate and the manipulation portion for mounting and dismounting the guiding duct are formed of the same member, the closure plate is rotated by the rotating manipulation of the manipulation portion so as to adjust the opening area of the ventilation hole, and the guiding duct is removed by the slide manipulation of the manipulation portion.

As the specific constitution of the above-mentioned third invention, for example, the fourth invention is directed to the constitution in which the manipulation portion for rotating the closure plate is slidably supported on the closure plate thus allowing the rotary manipulation of the manipulation portion with respect to the closure plate or the slide manipulation to remove the guiding duct in the manipulation portion.

Further, to prevent an erroneous manipulation of the above-mentioned manipulation portion thus preventing the removal of the guiding duct when the helmet is used, in the fifth invention, it is preferable that the helmet includes a locking portion which changes over the manipulation of the manipulation portion for mounting and dismounting the guiding duct between a locking state and a locking-released state.

According to the helmet of the present invention, it is possible to expect the following excellent advantageous effects.

According to the first invention, the guiding duct can be supported on the support portion and the support of the guiding duct can be released by the manipulation of the manipulation portion for mounting and dismounting the guiding duct.

Accordingly, it is possible to easily perform the mounting and dismounting of the guiding duct in the ventilation structure of the helmet.

Further, according to the second invention, it is possible to specifically provide the above-mentioned support portion.

Further, according to the third invention, it is possible to perform the rotary manipulation of the above-mentioned closure plate and the removal manipulation of the guiding duct at one place and, at the same time, the reduction of the constitutional members can be realized.

Further, according to the fourth invention, it is possible to specifically provide the constitution which can perform the rotary manipulation of the above-mentioned closure plate and the removal manipulation of the guiding duct at one place as well as the reduction of the constitutional members.

Further, according to the fifth invention, it is possible to prevent the removal of the guiding duct when the helmet is used by preventing the erroneous manipulation of the above-mentioned manipulation portion.

PREFERRED EMBODIMENTS OF THE INVENTION

The preferred embodiments for carrying out a helmet of the present invention are explained hereinafter in conjunction with drawings.

Figure 1:
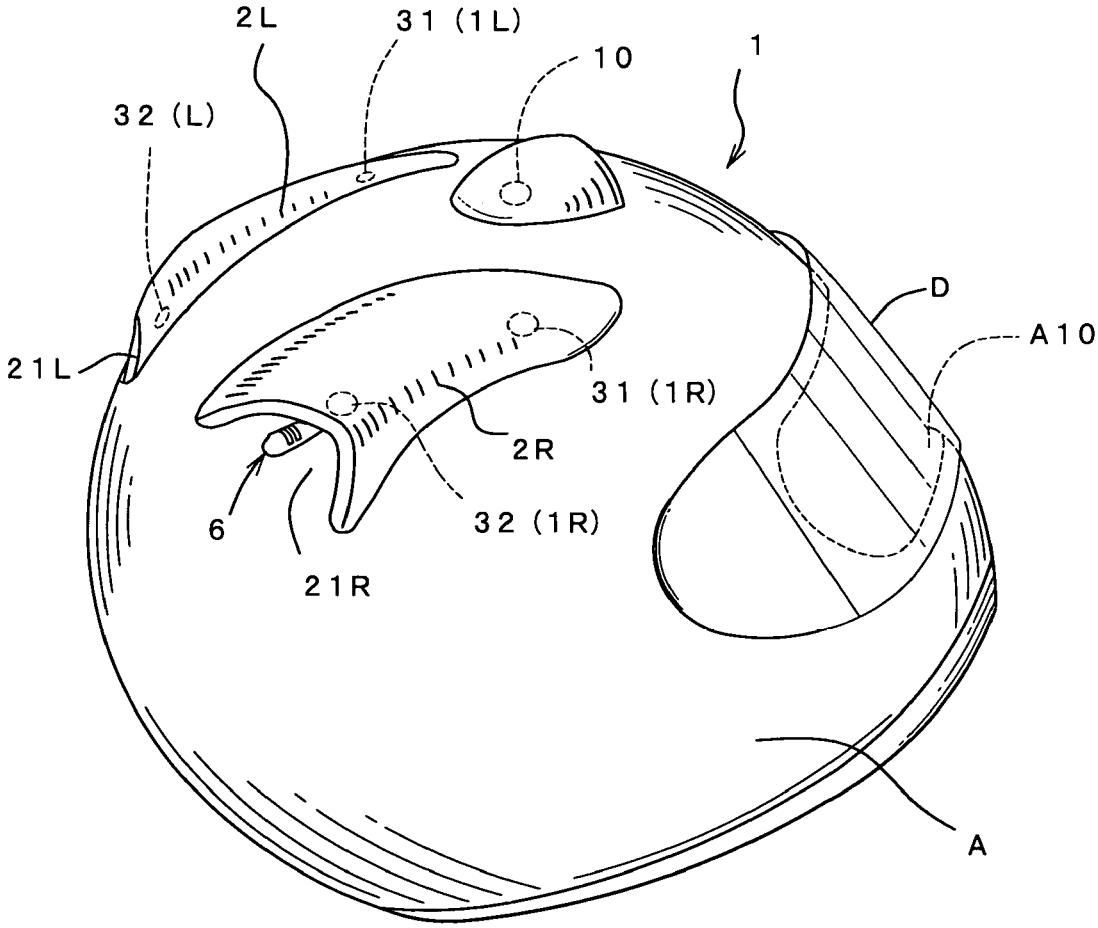
FIG. 1 is a perspective view of a helmet according to the present invention.
Figure 2:
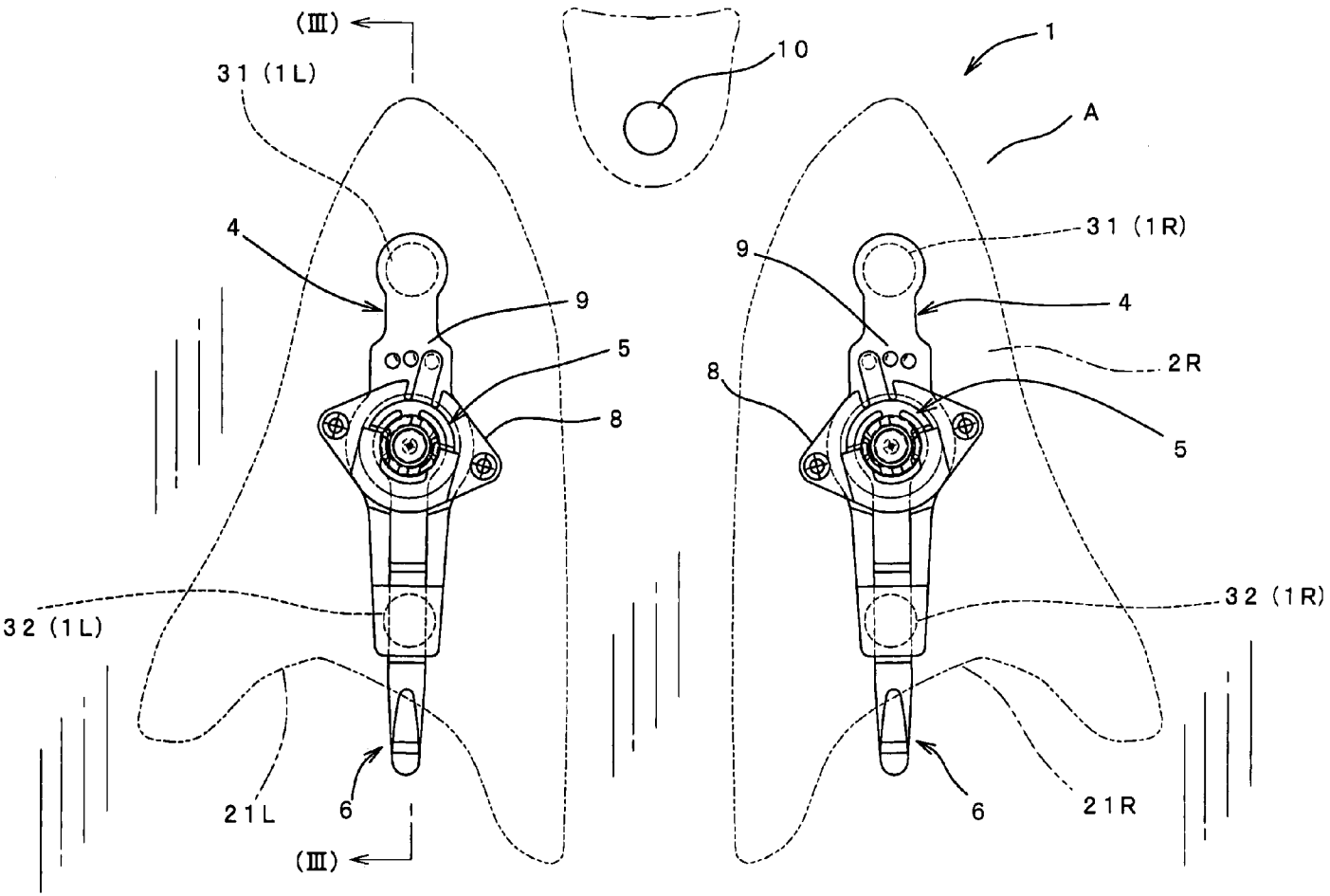
FIG. 2 is a plan view of a portion of FIG. 1.
Figure 3:
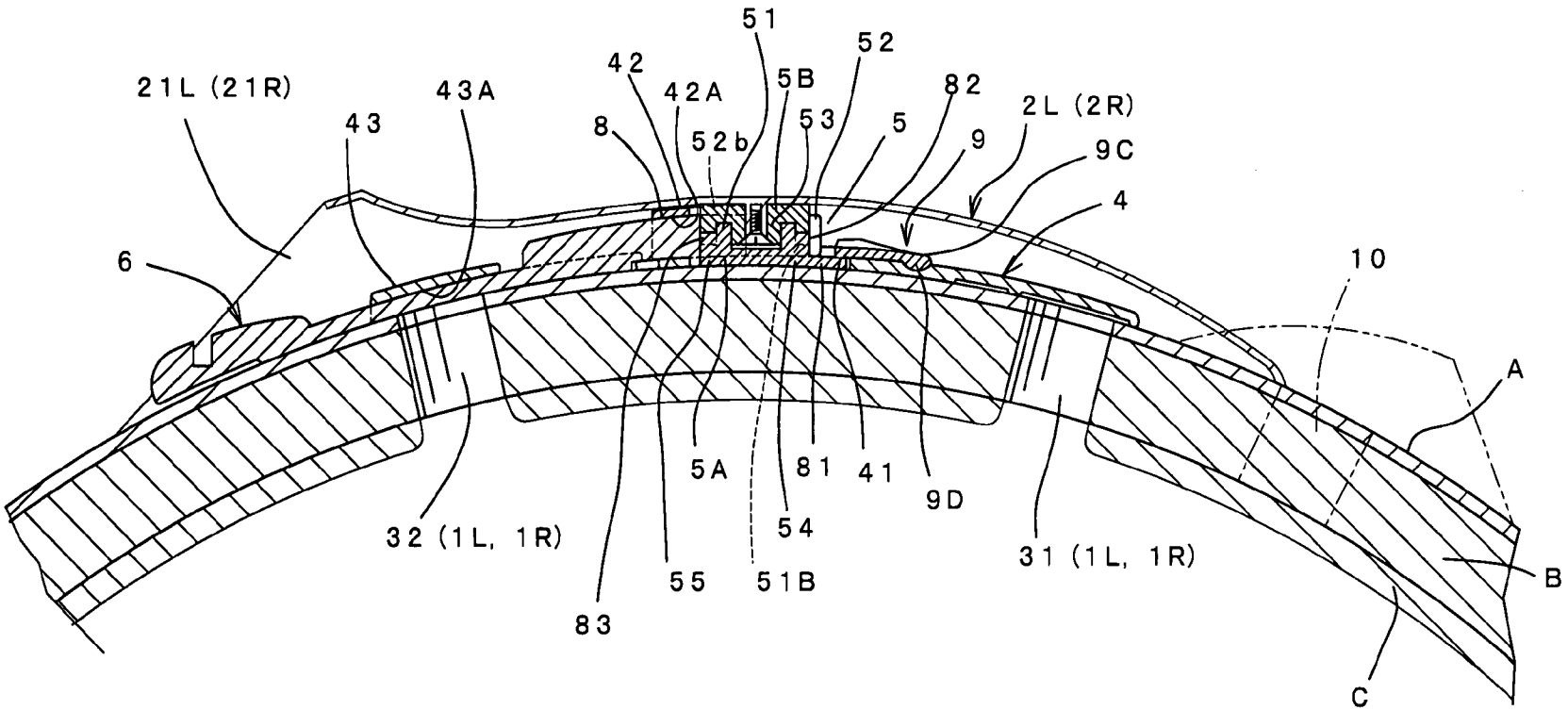
FIG. 3 is a cross-sectional view taken along a line (III)-(III) in FIG. 2.

A helmet which is illustrated in this mode for carrying out the present invention is a full-face type helmet. A helmet 1 arranges, inside a helmet body A which is formed by molding using a fiber-reinforced resin material, an expanded polystyrene liner B which is formed by molding using a foamed styrene material, and respective interior bodies C having cushion property which are formed by wrapping urethane materials, sponge materials and the like which are formed in predetermined shapes with cover members. Further, in the helmet body A, the helmet 1 arranges a shield member D which opens or closes an opening portion A10 formed in a front portion of the helmet body A and a chin strap (not shown in the drawing) which holds a helmet wearing state (see FIG. 1 to FIG. 3).

Further, the helmet 1 incorporates the ventilation structure therein.

The ventilation structure of this mode for carrying out the present invention is constituted of a traveling wind-introducing opening 10 which is opened in the vicinity of a center portion of a front side of the helmet body A, ventilation portions 1L, 1R which are respectively arranged on left and right sides of the traveling wind-introducing opening 10 which is used as a boundary in the vicinity of a top portion of the helmet body A, and guiding ducts 2L, 2R which are arranged above the ventilation portions 1L, 1R.

The traveling wind-introducing opening 10 is formed in the helmet body A in a state that the traveling wind-introducing opening 10 continuously penetrates from a surface of the helmet body A to an impact absorbing liner B of the helmet body A so as to introduce the traveling wind into the inside of the helmet 1 from the traveling wind-introducing opening 10.

This ventilation structure performs the ventilating operation such that the traveling wind is introduced into the inside of the helmet 1 from the traveling wind-introducing opening 10, and the introduced traveling wind forcibly discharges hot air inside the helmet 1 from the ventilation portions 1L, 1R.

That is, the guiding ducts 2L, 2R of this mode for carrying out the present invention include opening portions 21L, 21R only at rear portions thereof.

Hereinafter, the constructions of the ventilation portions 1L, 1R and the guiding ducts 2L, 2R are explained. In the following description, since the ventilation portions 1L, 1R have identical constructions, only the ventilation portion 1L is explained. Similarly, since the guiding ducts 2L, 2R have identical constructions, only the guiding duct 2L is explained. Here, the explanation of the ventilation portion 1R and the guiding duct 2R is omitted (see FIG. 3 to FIG. 10).

The ventilation portion 1L is includes ventilation 31,32 which are opened in two portions, that is, front holes and rear portions, a closure plate 4 which closes the ventilation holes 31,32, a support portion 5 which detachably supports the guiding duct 2L, and a manipulation portion 6 which releases the support state in which the guiding duct 2L is supported on the support portion 5 and, at the same time, performs an open/close operation of the closure plate 4.

In the same manner as the above-mentioned traveling wind introducing opening 10, the ventilation holes 31, 32 are formed in the helmet body A in a state that the ventilation holes 31, 32 continuously penetrates from the surface of the helmet body A to the impact absorbing liner B so as to forcibly discharge the hot air by the traveling wind which is introduced into the inside of the helmet 1 from the above-mentioned traveling wind introducing opening 10.

The closure plate 4 has a length which allows the closure plate 4 to close the above-mentioned ventilation holes 31, 32, and is rotatably supported in a planar direction using an approximately middle portion between the ventilation holes 31, 32 as the center of rotation.

To be more specific, the closure plate 4 integrally includes an inner engaging portion 51 described later which constitutes a portion of the above-mentioned support portion 5, is positioned between a mounting plate 8 which is mounted on the helmet body A using a fixing means such as a small bolt and the helmet body A, and a ring portion 41 provided at the center of rotation of the closure plate 4 is fitted on a rotary support portion 81 which is mounted on the mounting plate 8 thus rotatably supporting the closure plate 4 in a planar direction.

Further, a rotation restricting portion 9 which restricts a rotational range of the closure plate 4 is formed in a state that the rotation restricting portion 9 extends over the closure plate 4 and the mounting plate 8. The rotation restricting portion 9 includes three recessed portions 9A, 9B, 9C on the drawing which are formed in the closure plate 4 along a concentric circle which has the center thereof at the center of rotation of the closure plate 4, and a projecting portion 9D which is formed on the mounting plate 8 and changes over a fitting position with respect to the recessed portions 9A, 9B, 9C due to the rotation of the closure plate 4.

In this mode for carrying out the present invention, when the above-mentioned projecting portion 9D is fitted in the recessed portion 9C (see FIG. 4 and FIG. 5), the closure plate 4 maintains a fully closed state of the ventilation holes 31, 32, when the projecting portion 9D is fitted to the recessed portion 9B, the closure plate 4 maintains a half-opened state of the ventilation holes 31, 32, and when the projecting portion 9D is fitted to the recessed portion 9A (see FIG. 10), the closure plate 4 maintains a fully opened state of the ventilation holes 31, 32.

Here, the rotation restricting portion 9 which is illustrated in this mode for carrying out the invention of the present invention adopts a mode in which three recessed portions 9A, 9B, 9C are provided as described above. However, the number of recessed portions may be set to four or more thus realizing the adjustment of an opening area of the ventilation holes 31, 32 at a finer range.

Figure 10:
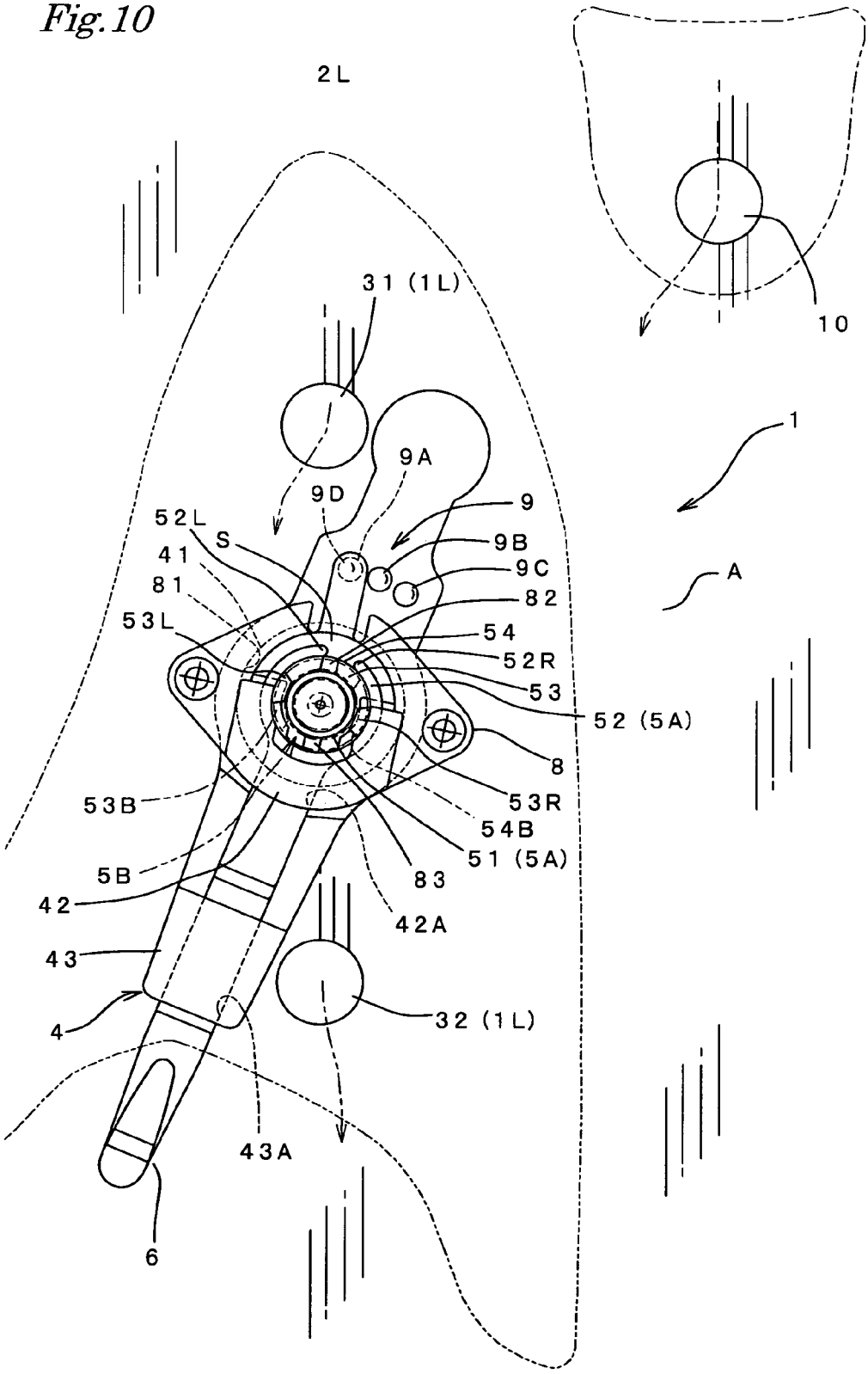
FIG. 10 is an enlarged plan view showing a state in which the manipulation portion is rotated in a planar direction.

Further, in the closure plate 4, the above-mentioned manipulation portion 6 which includes an outer engaging portion 52 described later which constitutes a portion of the above-mentioned support portion 5 on a distal end thereof is inserted in a state that the manipulation portion 6 is slidable in the longitudinal direction of the helmet body A with respect to slide guide holes 42A, 43A which are formed of a slide support portion 42 formed on the above-mentioned mounting plate 8, a slide support portion 43 formed on the closure plate 4 and the helmet body A, wherein the closure plate 4 is rotated by rotating the manipulation portion 6 in a planar direction (see FIG. 10).

Here, the above-mentioned manipulation portion 6 of this mode for carrying out the invention of the present invention is projected rearwardly from the opening portion 21L in a plan view to enable the manipulation of the manipulation portion 6 from the opening-portion-21L direction of the above-mentioned guiding duct 2L. However, in the present invention, provided that the manipulation portion can be manipulated, the manipulation portion 6 is not limited to the illustrated mode.

The above-mentioned support portion 5 is constituted of an engaging portion 5A which is formed of the above-mentioned inner engaging portion 51 and the above-mentioned outer engaging portion 52 which is concentrically arranged around the inner engaging portion 51, and a portion to be engaged 5B which is formed on a back surface of the guiding duct 2L and is detachably engaged with the above-mentioned engaging portion 5A.

In front of and behind the above-mentioned inner engaging portion 51, there are formed guide projections 54, 55 which assure an engaging groove portion 53 for the above-mentioned portion to be engaged 5B which is assured between the inner engaging portion 51 and the outer engaging portion 52, maintain the concentric state of the inner engaging portion 51 and the outer engaging portion 52, and guide the rotation of the outer engaging portion 52 which is rotated along with the rotation of the closure plate 4.

Distal end portions of the above-mentioned guide projections 54, 55 are formed in an arcuate shape which substantially conforms to an arcuate shape of an inner surface of the outer engaging portion 52 thus allowing the inner surface of the above-mentioned outer engaging portion 52 to be rotatably guided in a state that the inner surface of the outer engaging portion 52 is brought into contact with the distal end portion of the above-mentioned guide projections 54, 55.

Peripheral surfaces of the above-mentioned inner engaging portion 51 and outer engaging portion 52 and peripheral surfaces of the distal end portions of the above-mentioned guide projections 54, 55 conform to arcs of perfect circles which are respectively depicted as concentric circles.

In front of and behind the above-mentioned inner engaging portion 51, fitting projections 82, 83 which are fitted in the fitting recessed portions 51B, 52B formed in the above-mentioned portion to be engaged 5B are formed.

The above-mentioned outer engaging portion 52 is made of a synthetic resin material such a plastic and has a front portion thereof cut out to form a gap S.

A distance of the above-mentioned gap S is set narrower than a width of the above-mentioned guide projection 54 in the lateral direction, distal end portions 52L, 52R of the outer engaging portion 52 which are positioned at both ends of the gap S are brought into contact with the guide projection 54 due to the rearward sliding of the manipulation portion 6 and, at the same time, the distance of the gap S is expanded due to the rearward sliding of the manipulation portion 6 along the arc of the guide projection 54, and by expanding the distance of the gap S, the outer engaging portion 52 is made expandable in a planar direction and, at the same time, a biasing force is generated in the contracting direction from the expanded state.

Further, on an inner surface of the outer engaging portion 52, fitting projections 53L, 53R which are fitted in fitting groove portions 53B, 54B which are formed in the above-mentioned portion to be engaged 5B are formed in a projecting manner toward the inner engaging portion 51 in a state that the fitting projections 53L, 53R are positioned on the center line in the lateral direction.

On upper surfaces of the above-mentioned fitting projections 53L, 53R, inclined surfaces 54L, 54R which are gradually lowered from the outside to the inside are formed.

The above-mentioned portion to be engaged 5B is formed in an approximately cylindrical shape having a diameter which allows the portion to be engaged 5B to be properly fitted in the engaging groove 53, and is fixed to the back surface of the above-mentioned guiding duct 2L by a fixing means such as a small bolt.

Further, in the portion to be engaged 5B, the above-mentioned fitting recessed portions 51B, 52B and the above-mentioned fitting groove portions 53B, 54B are formed.

The above-mentioned fitting recessed portions 51B, 52B are formed by cutting out a peripheral brim of the portion to be engaged 5B along the axial direction of the portion to be engaged 5B.

The above-mentioned fitting groove portions 53B, 54B are formed by cutting out a peripheral surface of the portion to be engaged 5B along the radial direction of the portion to be engaged 5B.

The fitting projections 82, 83 in the above-mentioned inner engaging portion 51 and the fitting projections 53L, 53R in the outer engaging portion 52 also function as positioning members at the time of supporting the guiding duct 2L. Due to such a construction, it is possible to accurately position the guiding duct 2L at the time of removing the guiding duct 2L and, thereafter, mounting the guiding duct 2L again.

Figure 4:
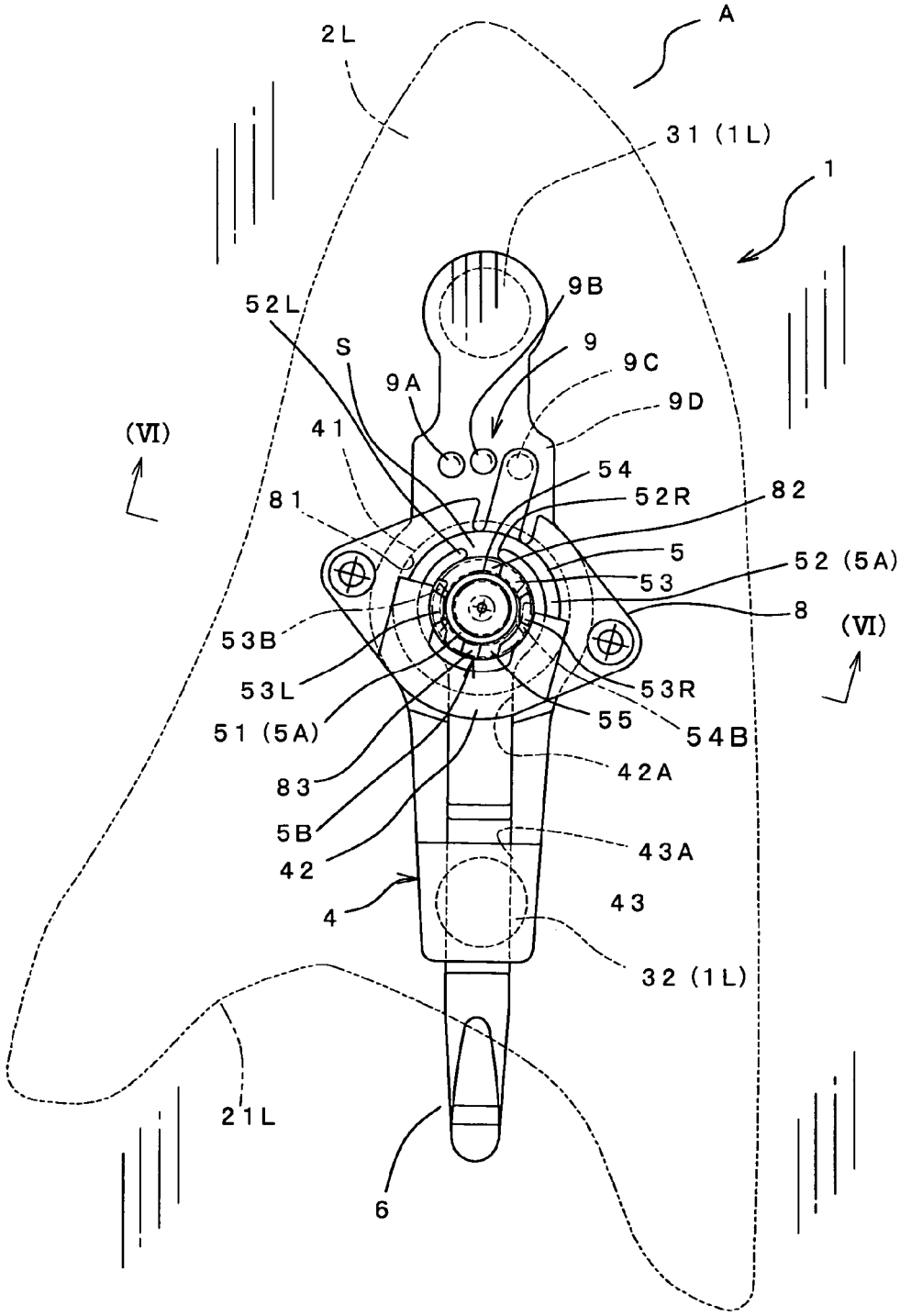
FIG. 4 is an enlarged plan view of an essential part.
Figure 5:
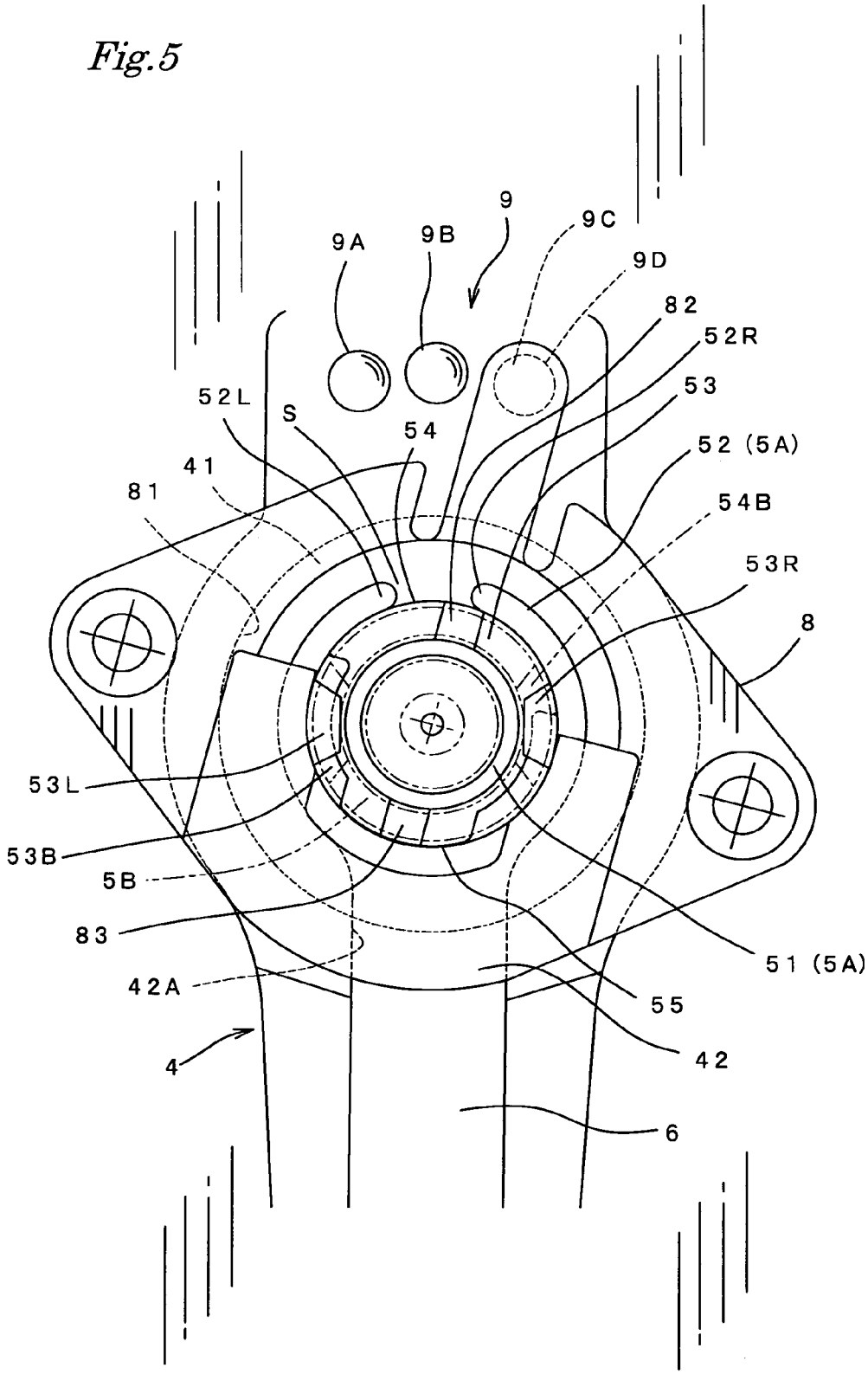
FIG. 5 is an enlarged plan view of the essential part in FIG. 4.
Figure 6:
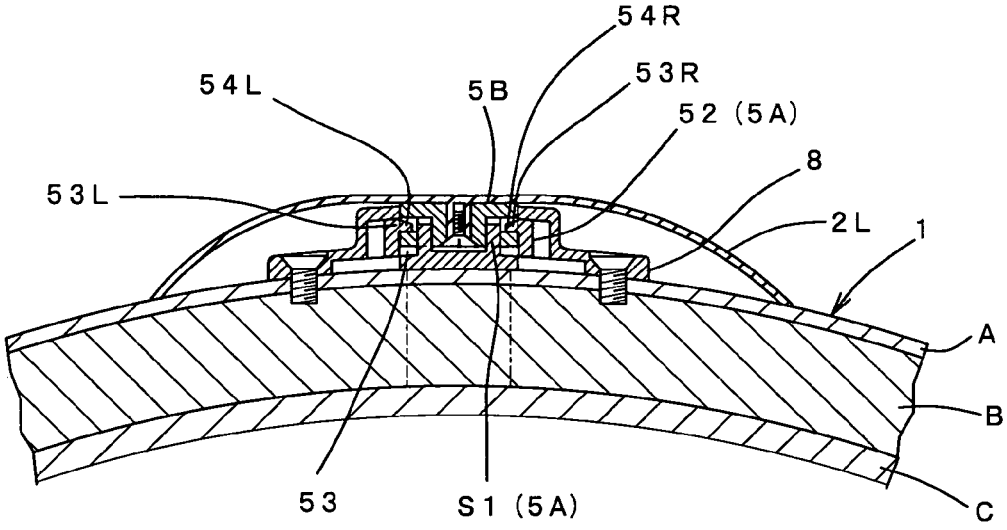
FIG. 6 is a cross-sectional view taken along a line (VI)-(VI) in FIG. 4.

With the provision of such a support portion 5, in a state that the above-mentioned guiding duct 2L is supported, the portion to be engaged 5B is engaged with the engaging portion 5A in a state that the engaging portion 5A is fitted in the above-mentioned engaging groove 53, the fitting projections 82, 83 are fitted in the above-mentioned fitting recessed portions 51B, 52B, and the fitting projections 53L, 53R are fitted in the fitting groove portions 53B, 54B (see FIG. 4 to FIG. 6)

Further, in removing the above-mentioned guiding duct 2L, when the above-mentioned manipulation portion 6 is made to slide rearwardly, the outer engaging portion 52 is moved rearwardly along with the sliding of the manipulation portion 6 and, at the same time, the distal end portions 52L, 52R formed on the outer engaging portion 52 are brought into contact with the guide projection 54, and the distance of the above-mentioned 52 in is expanded so as to expand the outer engaging portion 52 in the planar direction.

Figure 7:
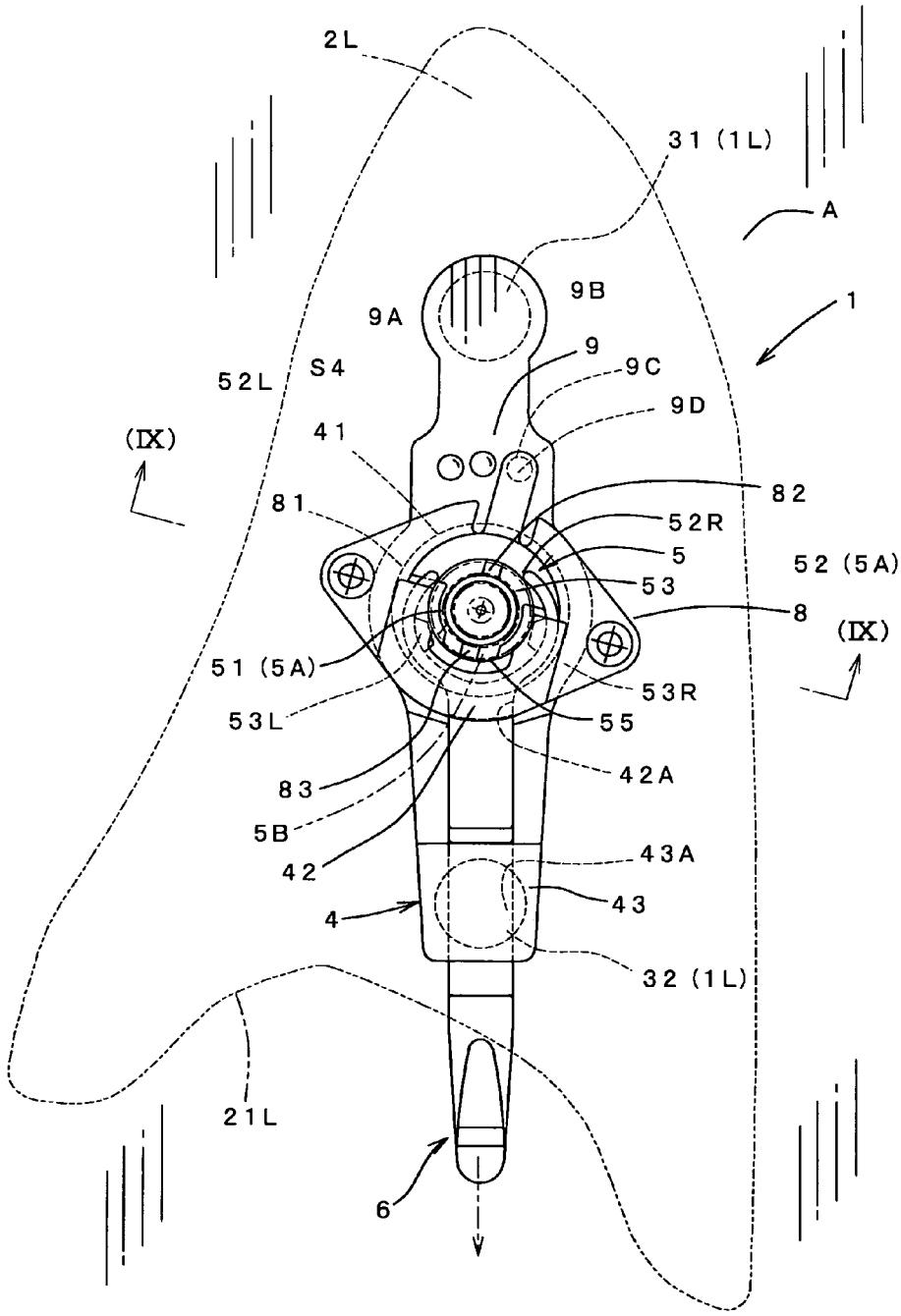
FIG. 7 is an enlarged plan view of an essential part showing a state in which a guiding duct is removed by allowing a manipulation portion to slide.
Figure 8:
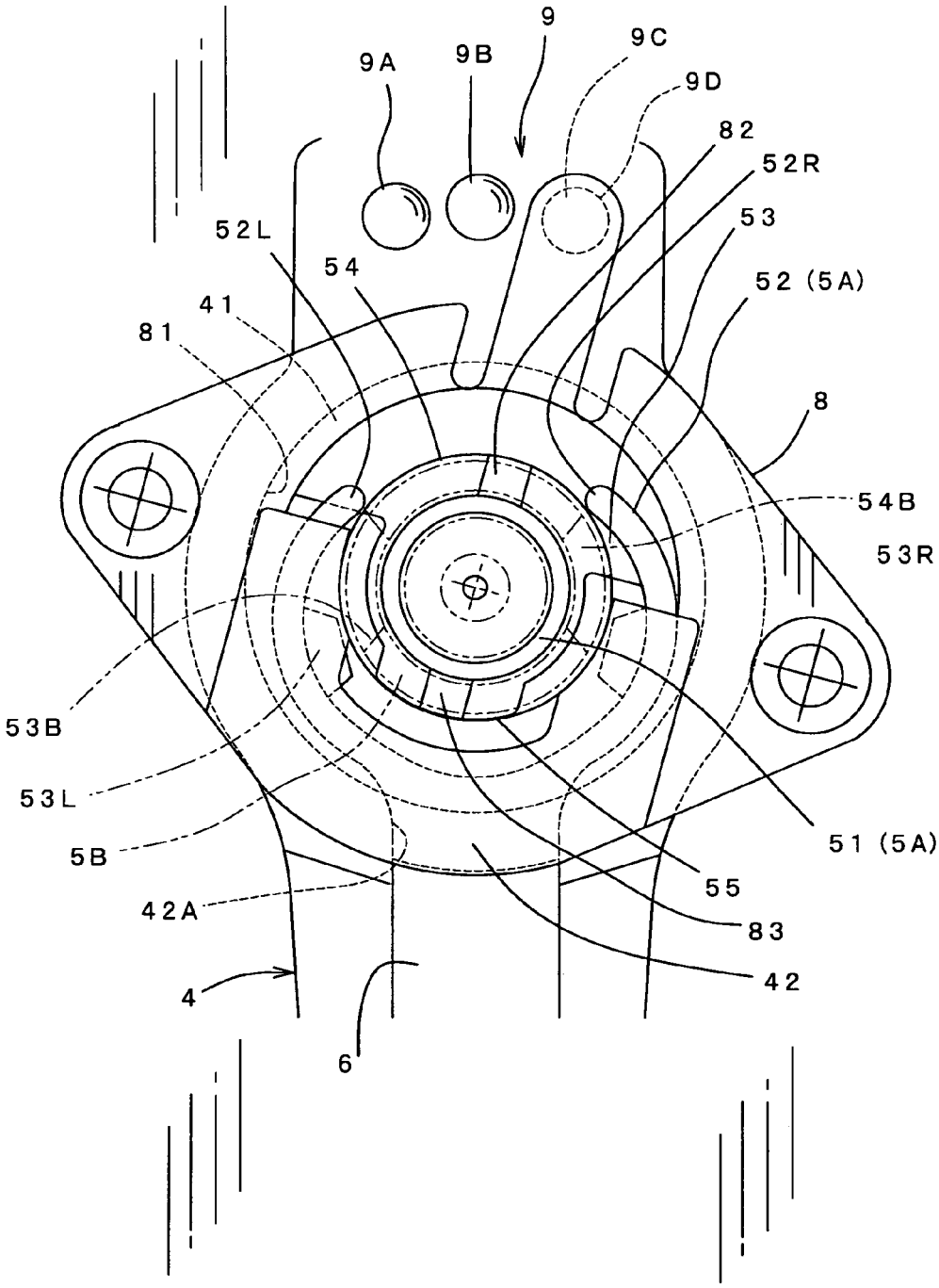
FIG. 8 is an enlarged plan view of the essential part in FIG. 7.
Figure 9:
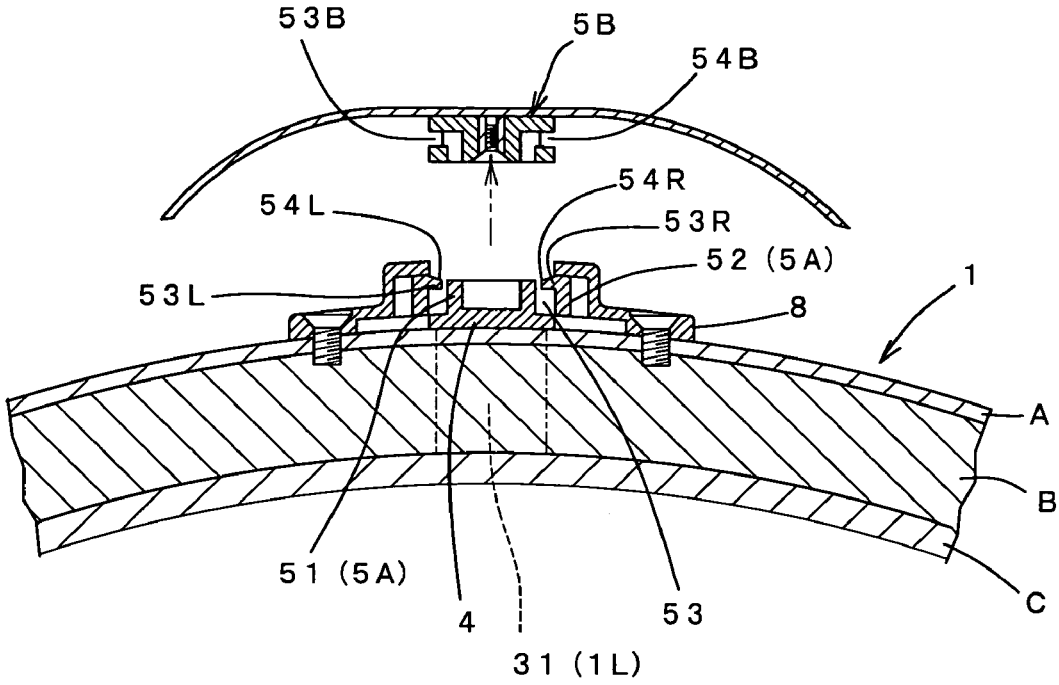
FIG. 9 is a cross-sectional view taken along a line (IX)-(IX) in FIG. 7.

Due to such an expansion of the outer engaging portion 52, the fitting of the fitting projections 53L, 53R into the above-mentioned fitting groove portions 53B, 54B is released and hence, the engagement of the portion to be engaged 5B with the engaging portion 5A can be released thus enabling the removal of the above-mentioned guiding duct 2L (see FIG. 7 to FIG. 9).

Further, when the above-mentioned guiding duct 2L is removed and a rearward sliding force applied to the manipulation portion 6 is released, due to a biasing force in the contracting direction applied to the outer engaging portion 52 which is generated due to the expansion of the distance of the above-mentioned gap S, the distance of the gap S is contracted along the arc of the guide projection 54 thus allowing the guiding duct 2L to slide forwardly. At a point of time that the outer engaging portion 52 becomes concentric with the inner engaging portion 51, the biasing force is lost, and the concentric state of the inner engaging portion 51 and the outer engaging portion 52 is maintained by the above-mentioned guide projections 54, 55.

Further, in mounting the removed guiding duct 2L again, when the portion to be engaged 5B is fitted in the engaging groove portion 53 formed in the engaging portion 5A by pushing, the distal end brim 55B of the portion to be engaged 5B is brought into contact with the inclined surfaces 54L, 54R of the fitting projections 53L, 53R and hence, a force in the direction to push down the fitting projections 53L, 53R is applied to the fitting projections 53L, 53R.

This force in the direction to push down the fitting projections 53L, 53R is converted into a force which expands the fitting projections 53L, 53R in the planar direction due to the inclined surfaces 54L, 54R, and due to this converted force, the outer engaging portion 52 is expanded and hence, the fitting groove portions 53B, 54B formed in the portion to be engaged SB assume positions at which the fitting groove portions 53B, 54B correctly face the fitting projections 53L, 53R and, at the same time, since the expanded outer engaging portion 52 is contracted due to the biasing force which is generated by the expansion, the fitting projections 53L, 53R are fitted in the fitting groove portions 53B, 54B.

Due to the fitting engagement of the fitting projections 53L, 53R with the fitting groove portions 53B, 54B, the portion to be engaged 5B is engaged with the engaging portion 5A thus mounting the guiding duct 2L on the helmet body A.

As described above, according to the helmet 1 of this mode for carrying out the present invention, opening areas of the ventilation holes 31, 32 can be controlled due to the rotary manipulation of the above-mentioned manipulation portion 6 in the planar direction and, at the same time, the support of the guiding duct 2L can be released due to the slide manipulation of the manipulation portion 6. Further, the portion to be engaged 5B formed on the guiding duct 2L side can be mounted by pushing the portion to be engaged 5B into the engaging portion 5A formed on the helmet body A side.

Figure 11:
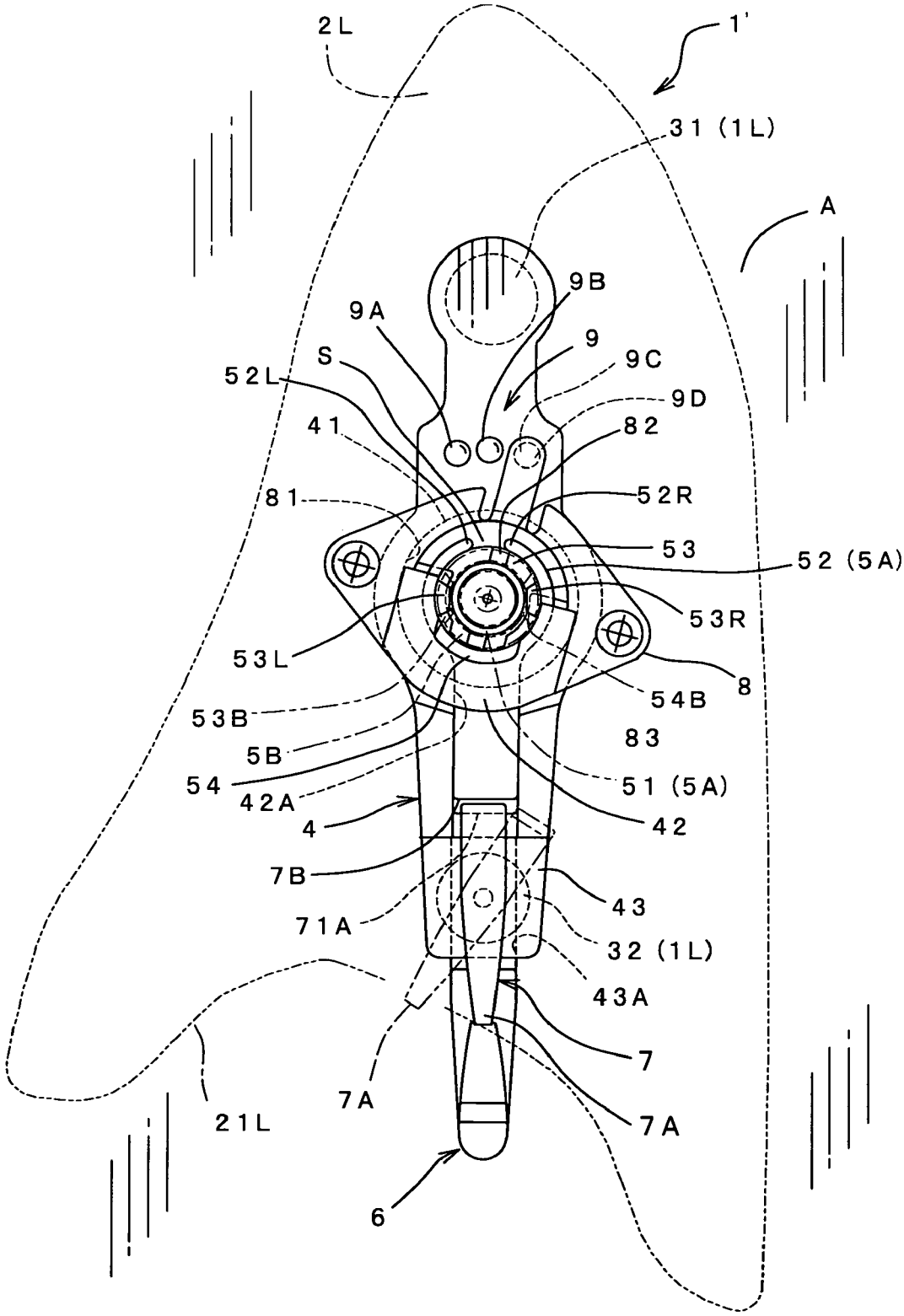
FIG. 11 is an enlarged plan view showing a second mode of the present invention.

FIG. 11 shows a second mode of the helmet of the present invention.

Here, a helmet 1' of this mode for carrying out the present invention includes a locking portion 7 which changes over the manipulation of the manipulation portion 6 between a locking state and a locking-released state. Here, the helmet 1' has the same structure as the helmet 1 of the above-mentioned mode for carrying out the present invention except for the locking portion 7 and hence, parts which overlap with the parts of the above-mentioned mode are given same numerals and their explanation is omitted.

The locking portion 7 is constituted of a rotary portion 7A which is rotatably and pivotally supported on a surface of the closure plate 4 in the planar direction and a fixing portion 7B which is mounted on the surface of the manipulation portion 6 in a projecting manner and is engaged with the rotary portion 7A in the longitudinal direction.

The rotary portion 7A forms a manipulation side on one end side thereof (a rear side of the helmet) and mounts a latching member 71A which extends downwardly on another end side (a front side of the helmet) thereof in a projecting manner. When the longitudinal direction of the rotary portion 7A is aligned with the longitudinal direction of the manipulation portion 6, a front end portion (a front side of the helmet) of the latching member 71A faces the fixing portion 7B and is positioned in the vicinity of the fixing portion 7B.

The fixing portion 7B is a stepped portion which is formed on a surface of the manipulation portion 6. To be more specific, the stepped portion is mounted on a surface of the helmet which is positioned on a front side of the helmet with respect to a slide support portion 43 which is used as a boundary. By allowing the rotary portion 7A to face the fixing portion 7B having such a constitution and to approach the fixing portion 7B, the manipulation of the manipulation portion 6 assumes the locking state.

Further, when the rotary portion 7A is rotated in the planar direction, the longitudinal direction of the rotary portion 7A is arranged orthogonal to the longitudinal direction of the manipulation portion 6, and the latching member 71A is arranged at a non-facing position with respect to the fixing portion 7B, then the locking state of the rotary portion 7A with respect to the fixing portion 7B is released.

According to the locking portion 7 having the above-mentioned constitution, in a state that the rotary portion 7A is held in the locking state with respect to the fixing portion 7B, when the manipulation portion 6 is made to slide in the support release direction of the guiding duct 2L, the fixing portion 7B is brought into contact with the latching member 71A of the rotary portion 7A which is pivotally supported on the closure plate 4 and hence, the sliding of the manipulation portion 6 in the support-releasing direction with respect to the guiding duct is prevented. Due to the prevention of the sliding of the manipulation portion 6, the engagement between the engaging portion 5A and the portion to be engaged 5B in the support portion 5 is maintained and hence, there is no possibility that the guiding duct 2L is removed from the helmet body A.

Further, when the locking state of the rotary portion 7A with respect to the fixing portion 7B is released, the manipulation portion 6 is allowed to slide in the support-release direction with respect to the guiding duct of the manipulation portion 6 and hence, in the same manner as the above-mentioned mode for carrying out the present invention, by allowing the manipulation portion 6 to slide rearwardly, it is possible to remove the guiding duct 2L from the helmet body A.

As described above, according to the mode of the present invention, in the same manner as the mode described above, the closure plate 4 is rotated by the rotary manipulation of the manipulation portion 6, the guiding duct 2L is removed by the slide manipulation of the manipulation portion 6, and further, the erroneous manipulation of the manipulation portion 6 is prevented and hence, it is possible to prevent the guiding duct from being removed from the helmet when the helmet is used.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

The entire disclosure of Japanese Patent Application No. 2006-107461 filed on Apr. 10, 2006 including specification, claims, drawings and summary are incorporated herein by reference in its entirety.

The invention claimed is:

1. A helmet comprising:

a ventilation hole for ventilating a surface of a helmet body;

a guiding duct which covers the ventilation hole;

a closure plate separately movable relative to the guiding duct which opens or closes the ventilation hole corresponding to the rotation in a direction along the hole surface of the helmet body and, at the same time, adjusts an opening area of the ventilation hole;

a manipulation portion for rotating the closure plate for rotatably manipulating the closure plate; and a support portion which detachably mounts the guiding duct is arranged at a center of rotation of the closure plate, and wherein the manipulation portion detaches the guiding duct from the support portion by a longitudinal motion of the manipulation portion.

2. The helmet according to claim 1, wherein the support portion includes an engaging portion which is provided to one of a helmet body side and the guiding duct side, and a portion to be engaged which is detachably engaged with the engaging portion and is provided to the other, the engaging portion is configured to be engaged with the portion to be engaged in a sandwiched manner so as to maintain a support state of the guiding duct and is also configured to release the engagement with the portion to be engaged by slide manipulation of the manipulation portion for detachably mounting the guiding duct so as to release the support state of the guiding duct.

3. The helmet according to claim 2, wherein the manipulation portion for rotating the closure plate and the manipulation portion for detachably mounting the guiding duct are formed of the same member, the closure plate is rotated by the rotating manipulation of the manipulation portion so as to adjust the opening area of the ventilation hole, and the guiding duct is removed by the slide manipulation of the manipulation portion.

4. The helmet according to claim 3, wherein the manipulation portion for rotating the closure plate is slidably supported on the closure plate thus allowing the rotary manipulation of the manipulation portion with respect to the closure plate or the slide manipulation to remove the guiding duct in the manipulation portion.

5. The helmet according to claim 4, wherein the helmet includes a locking portion which changes over the manipulation of the manipulation portion for mounting and dismounting the guiding duct between a locking state and a locking-released state.

6. The helmet according to claim 3, wherein the helmet includes a locking portion which changes over the manipulation of the manipulation portion for mounting and dismounting the guiding duct between a locking state and a locking-released state.

7. The helmet according to claim 2, wherein the helmet includes a locking portion which changes over the manipulation of the manipulation portion for mounting and dismounting the guiding duct between a locking state and a locking-released state.

8. The helmet according to claim 1, wherein the manipulation portion for rotating the closure plate and the manipulation portion for detachably mounting the guiding duct are formed of the same member, the closure plate is rotated by the rotating manipulation of the manipulation portion so as to adjust the opening area of the ventilation hole, and the guiding duct is removed by the slide manipulation of the manipulation portion.

9. The helmet according to claim 8, wherein the manipulation portion for rotating the closure plate is slidably supported on the closure plate thus allowing the rotary manipulation of the manipulation portion with respect to the closure plate or the slide manipulation to remove the guiding duct in the manipulation portion.

10. The helmet according to claim 9, wherein the helmet includes a locking portion which changes over the manipulation of the manipulation portion for mounting and dismounting the guiding duct between a locking state and a locking-released state.

11. The helmet according to claim 8, wherein the helmet includes a locking portion which changes over the manipulation of the manipulation portion for mounting and dismounting the guiding duct between a locking state and a locking-released state.

12. The helmet according to claim 1, wherein the helmet includes a locking portion which changes over the manipulation of the manipulation portion for mounting and dismounting the guiding duct between a locking state and a locking released state.

* * * * *